US007529673B2

(12) United States Patent
Mäkinen et al.

(10) Patent No.: US 7,529,673 B2
(45) **Date of Patent: *May 5, 2009**

(54) SPECTRAL PARAMETER SUBSTITUTION FOR THE FRAME ERROR CONCEALMENT IN A SPEECH DECODER

(75) Inventors: Jari Mäkinen, Tampere (FI); Hannu Mikkola, Tampere (FI); Janne Vainio, Pirkkala (FI); Jani Rotola-Pukkila, Kangasala (FI)

(73) Assignee: Nokia Corporation, Espoo (FI)

( * ) Notice: Subject to any disclaimer, the term of this patent is extended or adjusted under 35 U.S.C. 154(b) by 209 days.

This patent is subject to a terminal disclaimer.

(21) Appl. No.: 11/402,220

(22) Filed: Apr. 10, 2006

(65) Prior Publication Data

US 2007/0239462 A1 Oct. 11, 2007

Related U.S. Application Data

(63) Continuation of application No. 09/918,300, filed on Jul. 30, 2001, now Pat. No. 7,031,926.

(60) Provisional application No. 60/242,498, filed on Oct. 23, 2000.

(51) Int. Cl.
*G10L 19/00* (2006.01)

(52) U.S. Cl. ..... 704/265; 704/200; 704/258; 704/500

(58) Field of Classification Search ..... 704/200, 704/265, 258, 500; 714/774
See application file for complete search history.

(56) References Cited

U.S. PATENT DOCUMENTS 5,406,632 A 4/1995 Sogo et al.
5,502,713 A 3/1996 Lagerqvist et al.

(Continued)

FOREIGN PATENT DOCUMENTS

JP 7271391 10/1995

(Continued)

OTHER PUBLICATIONS

Digital cellular telecommunications system (Phase 2+); Substitution and muting of lost frames for Adaptive Multi Rate (AMR) speech traffic channels (GSM 06.91 version 7.1.1 Release 1998), "ETSI EN 301 705 (Apr. 2000), European Telecommunications Standards Institute 2000."

(Continued)

*Primary Examiner*—Daniel D Abebe
(74) *Attorney, Agent, or Firm*—Ware, Fressola, Van Der Sluys & Adolphson, LLP

(57) ABSTRACT

A method for use by a speech decoder in handling bad frames received over a communications channel a method in which the effects of bad frames are concealed by replacing the values of the spectral parameters of the bad frames (a bad frame being either a corrupted frame or a lost frame) with values based on an at least partly adaptive mean of recently received good frames, but in case of a corrupted frame (as opposed to a lost frame), using the bad frame itself if the bad frame meets a predetermined criterion. The aim of concealment is to find the most suitable parameters for the bad frame so that subjective quality of the synthesized speech is as high as possible.

25 Claims, 6 Drawing Sheets

U.S. PATENT DOCUMENTS

| | | | | |
|---|---|---|---|---|
| 5,530,750 | A * | 6/1996 | Akagiri | 704/500 |
| 5,598,506 | A | 1/1997 | Wigren et al. | |
| 5,634,082 | A * | 5/1997 | Shimoyoshi et al. | 704/200.1 |
| 5,717,822 | A | 2/1998 | Chen | |
| 5,862,518 | A | 1/1999 | Nomura et al. | |
| 5,873,065 | A * | 2/1999 | Akagiri et al. | 704/500 |
| 6,122,607 | A | 9/2000 | Ekudden et al. | |
| 6,292,774 | B1 | 9/2001 | Taori et al. | |
| 6,373,842 | B1 | 4/2002 | Coverdale et al. | |
| 6,377,915 | B1 * | 4/2002 | Sasaki | 704/206 |
| 6,418,408 | B1 | 7/2002 | Udaya Bhaskar et al. | |

FOREIGN PATENT DOCUMENTS

| | | |
|---|---|---|
| JP | 325594 | 12/1995 |
| JP | 7325594 | 12/1995 |
| JP | 8305398 | 11/1996 |
| JP | 10 22936 | 1/1998 |
| WO | WO 94/29851 | 12/1994 |
| WO | WO 99/66494 | 12/1999 |
| WO | WO 00/60579 | 10/2000 |

OTHER PUBLICATIONS

*Improved Substitution for Erroneous Ltp-Parameters in a Speech Decoder*, J. Mäkinen, J. Vainio, H. Mikkola, J. Pukkila, Norsig Symposium 2001, Oct. 18-20, 2001, XP002195905, Trondheim.

*Immittance Spectral Pairs (ISP) for Speech Encoding*, Bistritz, Y. et al, Statistical Signal and Array Processing. Minneapolis, Apr. 27-30, 1993, Proceedings of the International Conference on Acoustics, Speech, and Signal Processing (ICASSP), New York, IEEE, US, vol. 4, Apr. 27, 1993, pp. 9-12, XP010110380.

TSG-SA Codec Working Group: "3G TS 26.091" Technical Specification Group Services and System Aspects, Yokohama, Japan, Apr. 26-28, 1999, XP002195906.

"Reconstruction of Missing packets for CELP-Based Speech Coders", Aamir Husain and Vladimir Cuperman, School of Engineering Science, Simon Fraser University, Burnaby, BC V5A IS6, Canada, 0-7803-2431-5/95 1995 IEEE.

"Classification and Spectral Extrapolation Based Packet Reconstruction for Low-Delay Speech Coding" Aamir Husain and Vladimire Cuperman, School of Engineering Science, Simon Fraser University, Burnaby, BCV5A IS6, Canada, 0-7803-1820-X/94 1994 IEEE.

Digital cellular telecommunications system (Phase 2+); Substitution and muting of lost frames for Adaptive Multi Rate (AMR) speech traffic channels (GSM 06.91 version 7.1.1 Release 1998) ETSI EN 301 705 V7.1.1 (Apr. 2000).

"Combatting Packet Losses by Model Based Source Prediction", Jonas Lindblom and Per Hedelin, Information Theory Group, 1999, Department of Signals and Systems, Chalmers Universtiy of Technology, S-412 96 Göteborg, Swededn, jonas.lindblom@s2.chalmers.se.

* cited by examiner

SPECTRAL PARAMETER SUBSTITUTION FOR THE FRAME ERROR CONCEALMENT IN A SPEECH DECODER

CROSS-REFERENCE TO RELATED APPLICATIONS

This application claims priority under 35 USC §119(e)(1) to provisional application Ser. No. 60/242,498 filed Oct. 23, 2000.

This application is also a continuation of U.S. patent application Ser. No. 09/918,300 filed 30 Jul. 2001 now U.S. Pat. No. 7,031,926, from which priority is claimed under all applicable sections of Title 35 of the United States Code including, but not limited to, Sections 120, 121, and 365(c).

FIELD OF THE INVENTION

The present invention relates to speech decoders, and more particularly to methods used to handle bad frames received by speech decoders.

BACKGROUND OF THE INVENTION

In digital cellular systems, a bit stream is said to be transmitted through a communication channel connecting a mobile station to a base station over the air interface. The bit stream is organized into frames, including speech frames. Whether or not an error occurs during transmission depends on prevailing channel conditions. A speech frame that is detected to contain errors is called simply a bad frame. According to the prior art, in case of a bad frame, speech parameters derived from past correct parameters (of non-erroneous speech frames) are substituted for the speech parameters of the bad frame. The aim of bad frame handling by making such a substitution is to conceal the corrupted speech parameters of the erroneous speech frame without causing a noticeable degrading of the speech quality.

Modern speech codecs operate by processing a speech signal in short segments, the above-mentioned frames. A typical frame length of a speech codec is 20 ms, which corresponds to 160 speech samples, assuming an 8 kHz sampling frequency. In so-called wideband codecs, frame length can again be 20 ms, but can correspond to 320 speech samples, assuming a 16 kHz sampling frequency. A frame may be further divided into a number of subframes.

For every frame, an encoder determines a parametric representation of the input signal. The parameters are quantized and then transmitted through a communication channel, in digital form. A decoder produces a synthesized speech signal based on the received parameters (see FIG. 1).

A typical set of extracted coding parameters includes spectral parameters (so called linear predictive coding parameters, or LPC parameters) used in short-term prediction, parameters used for long-term prediction of the signal (so called long-term prediction parameters or LTP parameters), various gain parameters, and finally, excitation parameters.

What is called linear predictive coding is a widely used and successful method for coding speech for transmission over a communication channel; it represents the frequency shaping attributes of the vocal tract. LPC parameterization characterizes the shape of the spectrum of a short segment of speech. The LPC parameters can be represented as either LSFs (Line Spectral Frequencies) or, equivalently, as ISPs (Immittance Spectral Pairs). ISPs are obtained by decomposing the inverse filter transfer function A(z) to a set of two transfer functions, one having even symmetry and the other having odd symmetry. The ISPs, also called Immittance Spectral Frequencies (ISFs), are the roots of these polynomials on the z-unit circle. Line Spectral Pairs (also called Line Spectral Frequencies) can be defined in the same way as Immittance Spectral Pairs; the difference between these representations is the conversion algorithm, which transforms the LP filter coefficients into another LPC parameter representation (LSP or ISP).

Sometimes the condition of the communication channel through which the encoded speech parameters are transmitted is poor, causing errors in the bit stream, i.e. causing frame errors (and so causing bad frames). There are two kinds of frame errors: lost frames and corrupted frames. In a corrupted frame, only some of the parameters describing a particular speech segment (typically of 20 ms duration) are corrupted. In a lost frame type of frame error, a frame is either totally corrupted or is not received at all.

In a packet-based transmission system for communicating speech (a system in which a frame is usually conveyed as a single packet), such as is sometimes provided by an ordinary Internet connection, it is possible that a data packet (or frame) will never reach the intended receiver or that a data packet (or frame) will arrive so late that it cannot be used because of the real-time nature of spoken speech. Such a frame is called a lost frame. A corrupted frame in such a situation is a frame that does arrive (usually within a single packet) at the receiver but that contains some parameters that are in error, as indicated for example by a cyclic redundancy check (CRC). This is usually the situation in a circuit-switched connection, such as a connection in a system of the global system for mobile communication (GSM) connection, where the bit error rate (BER) in a corrupted frame is typically below 5%.

Thus, it can be seen that the optimal corrective response to an incidence of a bad frame is different for the two cases of bad frames (the corrupted frame and the lost frame). There are different responses because in case of corrupted frames, there is unreliable information about the parameters, and in case of lost frames, no information is available.

According to the prior art, when an error is detected in a received speech frame, a substitution and muting procedure is begun; the speech parameters of the bad frame are replaced by attenuated or modified values from the previous good frame, although some of the least important parameters from the erroneous frame are used, e.g. the code excited linear prediction parameters (CELPs), or more simply the excitation parameters.

In some methods according to the prior art, a buffer is used (in the receiver) called the parameter history, where the last speech parameters received without error are stored. When a frame is received without error, the parameter history is updated and the speech parameters conveyed by the frame are used for decoding. When a bad frame is detected, via a CRC check or some other error detection method, a bad frame indicator (BFI) is set to true and parameter concealment (substitution for and muting of the corresponding bad frames) is then begun; the prior-art methods for parameter concealment use parameter history for concealing corrupted frames. As mentioned above, when a received frame is classified as a bad frame (BFI set to true), some speech parameters may be used from the bad frame; for example, in the example solution for corrupted frame substitution of a GSM AMR (adaptive multi-rate) speech codec given in ETSI (European Telecommunications Standards Institute) specification 06.91, the excitation vector from the channel is always used. When a speech frame is lost (including the situation where a frame arrives too late to be used, such as for example in some IP-based transmission systems), obviously no parameters are available from the lost frame to be used.

In some prior-art systems, the last good spectral parameters received are substituted for the spectral parameters of a bad frame, after being slightly shifted towards a constant predetermined mean. According to the GSM 06.91 ETSI specification, the concealment is done in LSF format, and is given by the following algorithm, For i=0 to N−1:

$$LSF_q1(i)=\alpha*\text{past}_LSF_q(i)+(1-\alpha)*\text{mean}_LSF(i);$$

$$LSF_q2(i)=LSF_q1(i); \quad \text{(eq. 1.0)}$$

where $\alpha=0.95$ and N is the order of the linear predictive (LP) filter being used. The quantity LSF_q1 is the quantized LSF vector of the second subframe, and the quantity LSF_q2 is the quantized LSF vector of the fourth subframe. The LSF vectors of the first and third subframes are interpolated from these two vectors. (The LSF vector for the first subframe in the frame n is interpolated from LSF vector of fourth subframe in the frame n−1, i.e. the previous frame). The quantity past_LSF_q is the quantity LSF_q2 from the previous frame. The quantity mean_LSF is a vector whose components are predetermined constants; the components do not depend on a decoded speech sequence. The quantity mean_LSF with constant components generates a constant speech spectrum.

Such prior-art systems always shift the spectrum coefficients towards constant quantities, here indicated as mean_LSF(i). The constant quantities are constructed by averaging over a long time period and over several successive talkers. Such systems therefore offer only a compromise solution, not a solution that is optimal for any particular speaker or situation; the tradeoff of the compromise is between leaving annoying artifacts in the synthesized speech, and making the speech more natural in how it sounds (i.e. the quality of the synthesized speech).

What is needed is an improved spectral parameter substitution in case of a corrupted speech frame, possibly a substitution based on both an analysis of the speech parameter history and the erroneous frame. Suitable substitution for erroneous speech frames has a significant effect on the quality of the synthesized speech produced from the bit stream.

SUMMARY OF THE INVENTION

Accordingly, the present invention provides a method and corresponding apparatus for concealing the effects of frame errors in frames to be decoded by a decoder in providing synthesized speech, the frames being provided over a communication channel to the decoder, each frame providing parameters used by the decoder in synthesizing speech, the method including the steps of: determining whether a frame is a bad frame; and providing a substitution for the parameters of the bad frame based on an at least partly adaptive mean of the spectral parameters of a predetermined number of the most recently received good frames.

In a further aspect of the invention, the method also includes the step of determining whether the bad frame conveys stationary or non-stationary speech, and, in addition, the step of providing a substitution for the bad frame is performed in a way that depends on whether the bad frame conveys stationary or non-stationary speech. In a still further aspect of the invention, in case of a bad frame conveying stationary speech, the step of providing a substitution for the bad frame is performed using a mean of parameters of a predetermined number of the most recently received good frames. In another still further aspect of the invention, in case of a bad frame conveying non-stationary speech, the step of providing a substitution for the bad frame is performed using at most a predetermined portion of a mean of parameters of a predetermined number of the most recently received good frames.

In another further aspect of the invention, the method also includes the step of determining whether the bad frame meets a predetermined criterion, and if so, using the bad frame instead of substituting for the bad frame. In a still further aspect of the invention with such a step, the predetermined criterion involves making one or more of four comparisons: an inter-frame comparison, an intra-frame comparison, a two-point comparison, and a single-point comparison.

From another perspective, the invention is a method for concealing the effects of frame errors in frames to be decoded by a decoder in providing synthesized speech, the frames being provided over a communication channel to the decoder, each frame providing parameters used by the decoder in synthesizing speech the method including the steps of: determining whether a frame is a bad frame; and providing a substitution for the parameters of the bad frame, a substitution in which past immittance spectral frequencies (ISFs) are shifted towards a partly adaptive mean given by:

$$ISF_q(i)=\alpha*\text{past}_ISF_q(i)+(1-\alpha)*\ ISF_{mean}(i), \text{ for } i=0\ldots16,$$

where $\alpha=0.9$, $ISF_q(i)$ is the $i^{th}$ component of the ISF vector for a current frame, $\text{past}_ISF_q(i)$ is the $i^{th}$ component of the ISF vector from the previous frame, $ISF_{mean}(i)$ is the $i^{th}$ component of the vector that is a combination of the adaptive mean and the constant predetermined mean ISF vectors, and is calculated using the formula:

$$ISF_{mean}(i)=\beta*ISF_{const_mean}(i)+(1-\beta)*\ ISF_{adaptive_mean}(i), \text{ for } i=0\ldots16,$$

where $\beta=0.75$, where $$ISF_{\text{adaptive_mean}}(i)=\frac{1}{3}\sum_{i=0}^{2}\text{past_ISF}_q(i)$$

and is updated whenever BFI=0 where BFI is a bad frame indicator, and where $ISF_{const_mean}(i)$ is the $i^{th}$ component of a vector formed from a long-time average of ISF vectors.

BRIEF DESCRIPTION OF THE DRAWINGS

The above and other objects, features and advantages of the invention will become apparent from a consideration of the subsequent detailed description presented in connection with accompanying drawings, in which.

BEST MODE FOR CARRYING OUT THE INVENTION

Figure 1:
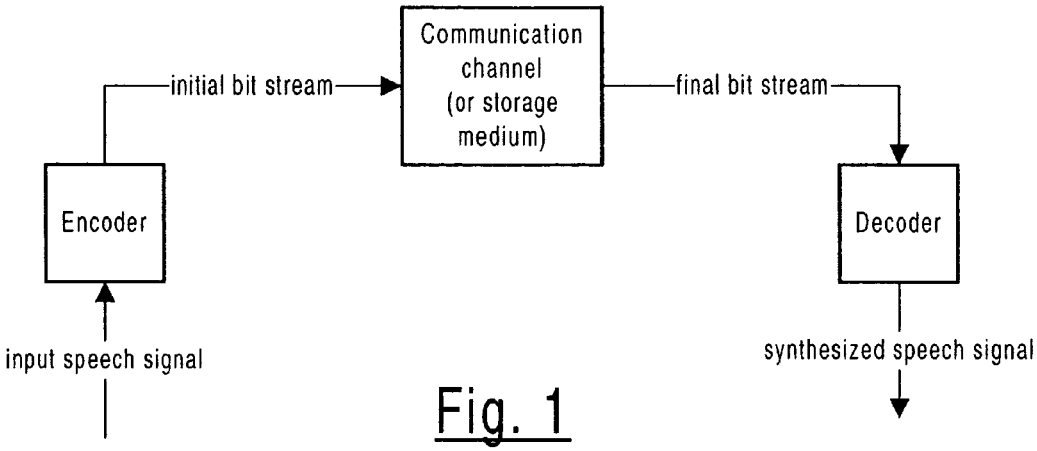
Fig. 1 (prior art)
FIG. 1 is a block diagram of components of a system according to the prior art for transmitting or storing speech and audio signal.

According to the invention, when a bad frame is detected by a decoder after transmission of a speech signal through a communication channel (FIG. 1), the corrupted spectral parameters of the speech signal are concealed (by substituting other spectral parameters for them) based on an analysis of the spectral parameters recently communicated through the communication channel. It is important to effectively conceal corrupted spectral parameters of a bad frame not only because the corrupted spectral parameters may cause artifacts (audible sounds that are obviously not speech), but also because the subjective quality of subsequent error-free speech frames decreases (at least when linear predictive quantization is used).

An analysis according to the invention also makes use of the localized nature of the spectral impact of the spectral parameters, such as line spectral frequencies (LSFs). The spectral impact of LSFs is said to be localized in that if one LSF parameter is adversely altered by a quantization and coding process, the LP spectrum will change only near the frequency represented by the LSF parameter, leaving the rest of the spectrum unchanged.

The Invention in General, for Either a Lost Frame or a Corrupt Frame

According to the invention, an analyzer determines the spectral parameter concealment in case of a bad frame based on the history of previously received speech parameters. The analyzer determines the type of the decoded speech signal (i.e. whether it is stationary or non-stationary). The history of the speech parameters is used to classify the decoded speech signal (as stationary or not, and more specifically, as voiced or not); the history that is used can be derived mainly from the most recent values of LTP and spectral parameters.

The terms stationary speech signal and voiced speech signal are practically synonymous; a voiced speech sequence is usually a relatively stationary signal, while an unvoiced speech sequence is usually not. We use the terminology stationary and non-stationary speech signals here because that terminology is more precise.

A frame can be classified as voiced or unvoiced (and also stationary or non-stationary) according to the ratio of the power of the adaptive excitation to that of the total excitation, as indicated in the frame for the speech corresponding to the frame. (A frame contains parameters according to which both adaptive and total excitation are constructed; after doing so, the total power can be calculated.)

Figure 2:
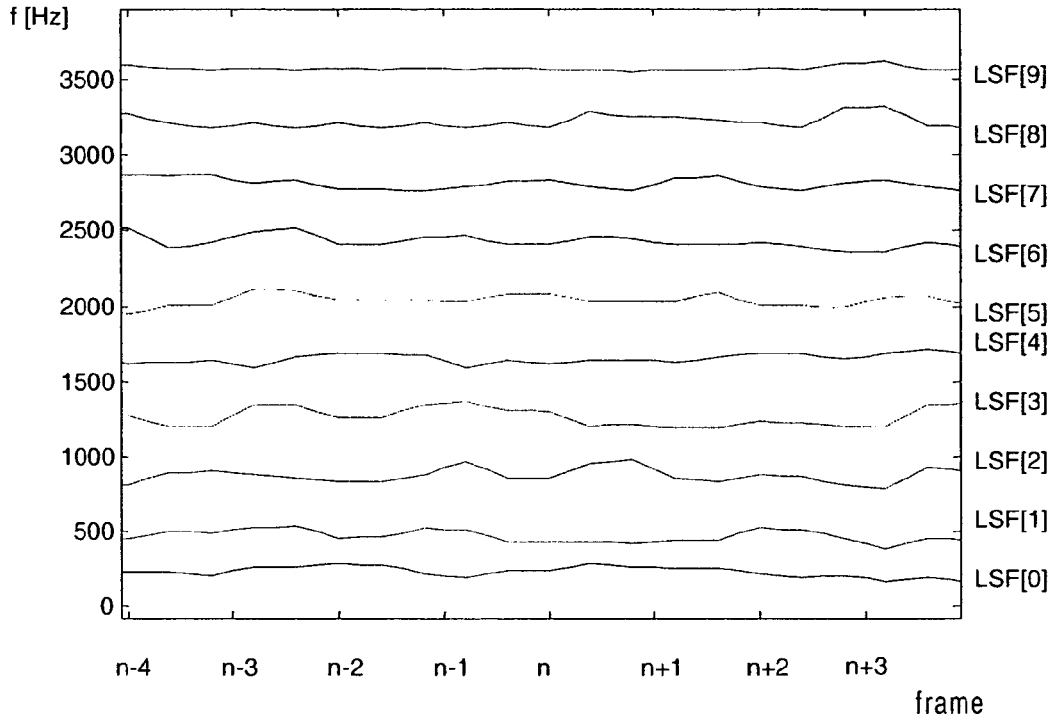
FIG. 2 is a graph illustrating LSF coefficients [0 . . . 4 kHz] of adjacent frames in a case of stationary speech, the Y-axis being frequency and the X-axis being frames.

If a speech sequence is stationary, the methods of the prior art by which corrupted spectral parameters are concealed, as indicated above, are not particularly effective. This is because stationary adjacent spectral parameters are changing slowly, so the previous good spectral values (not corrupted or lost spectral values) are usually good estimates for the next spectral coefficients, and more specifically, are better than the spectral parameters from the previous frame driven towards the constant mean, which the prior art would use in place of the bad spectral parameters (to conceal them). FIG. 2 illustrates, for a stationary speech signal (and more particularly a voiced speech signal), the characteristics of LSFs, as one example of spectral parameters; it illustrates LSF coefficients [0 . . . 4 kHz] of adjacent frames of stationary speech, the Y-axis being frequency and the X-axis being frames, showing that the LSFs do change relatively slowly, from frame to frame, for stationary speech.

During stationary speech segments, concealment is performed according to the invention (for either lost or corrupted frames) using the following algorithm:

For i=0 to N−1 (elements within a frame):

$$\text{adaptive_mean}_LSF(i)=(\text{past}_LSF_\text{good}(i)(0)+\text{past}_LSF_\text{good}(i)(1)+\ldots+\text{past}_LSF_\text{good}(i)(K-1))/K;$$

$$LSF_q1(i)=\alpha*\text{past_LSF_qood}(i)(0)+(1-\alpha)*\text{adaptive_mean_LSF}(i);$$

$$\text{LSF}_q2(i)=\text{LSF}_q1(i). \tag{2.1}$$

where $\alpha$ can be approximately 0.95, N is the order of LP filter, and K is the adaptation length. LSF_q1(i) is the quantized LSF vector of the second subframe and LSF_q2(i) is the quantized LSF vector of the fourth subframe. The LSF vectors of the first and third subframes are interpolated from these two vectors. The quantity past_LSF_qood(i)(0) is equal to the value of the quantity LSF_q2(i−1) from the previous good frame. The quantity past_LSF_good(i)(n) is a component of the vector of LSF parameters from the $n+1^{th}$ previous good frame (i.e. the good frame that precedes the present bad frame by n+1 frames). Finally, the quantity adaptive_mean_LSF(i) is the mean (arithmetic average) of the previous good LSF vectors (i.e. it is a component of a vector quantity, each component being a mean of the corresponding components of the previous good LSF vectors).

Figure 4:
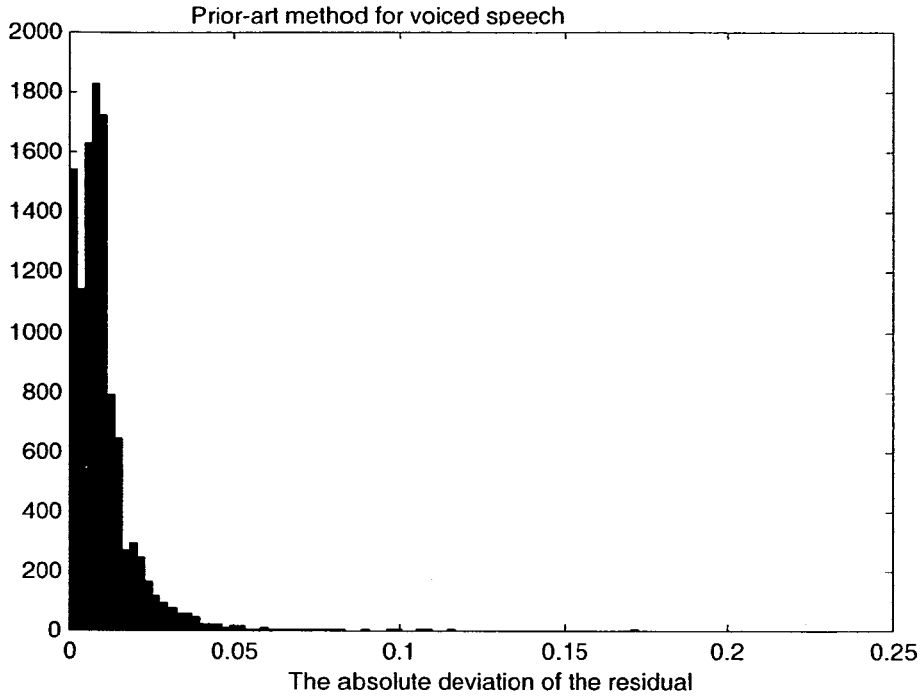
FIG. 4. is a graph illustrating absolute spectral deviation error in the prior-art method.
Figure 5:
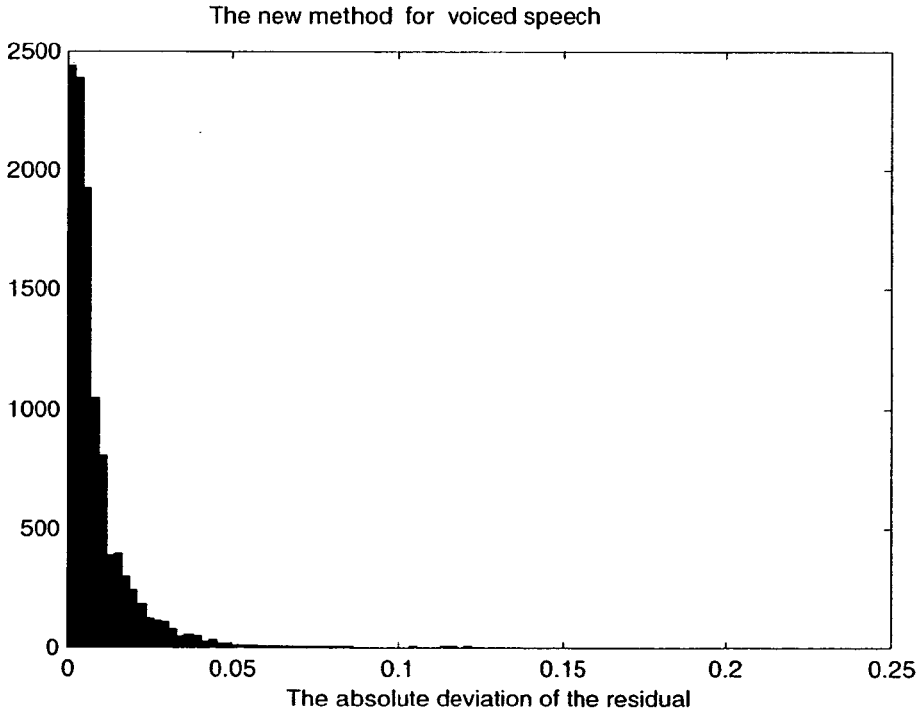
FIG. 5 is a graph illustrating absolute spectral deviation error in the present invention (showing that the present invention gives better substitution for spectral parameters than the prior-art method), where the highest bar in the graph (indicating the most probable residual) is approximately zero.

It has been demonstrated that the adaptive mean method of the invention improves the subjective quality of synthesized speech compared to the method of the prior art. The demonstration used simulations where speech is transmitted through an error-inducing communication channel. Each time a bad frame was detected, the spectral error was calculated. The spectral error was obtained by subtracting, from the original spectrum, the spectrum that was used for concealing during the bad frame. The absolute error is calculated by taking the absolute value from the spectral error. FIGS. 4 and 5 show the histograms of absolute deviation error of LSFs for the prior art and for the invented method, respectively. The optimal error concealment has an error close to zero, i.e. when the error is close to zero, the spectral parameters used for concealing are very close to the original (corrupted or lost) spectral parameters. As can be seen from the histograms of FIGS. 4 and 5, the adaptive mean method of the invention (FIG. 5) conceals errors better than the prior-art method (FIG. 4) during stationary speech sequences.

Figure 3:
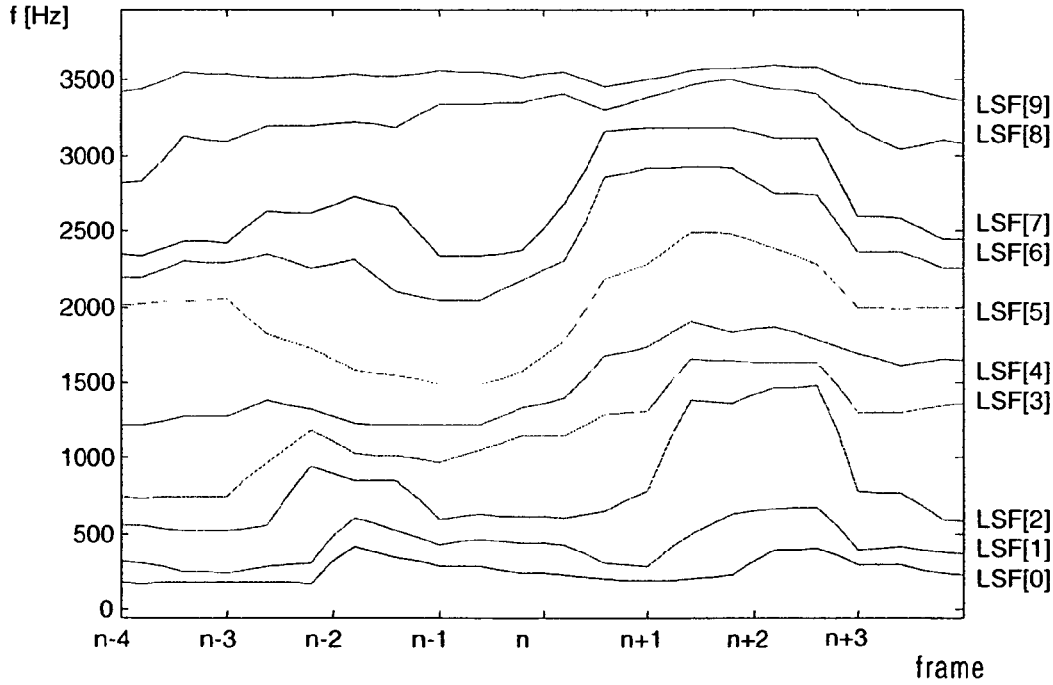
FIG. 3. is a graph illustrating LSF coefficients [0 . . . 4 kHz] of adjacent frames in case of non-stationary speech, the Y-axis being frequency and the X-axis being frames.

As mentioned above, the spectral coefficients of non-stationary signals (or, less precisely, unvoiced signals) fluctuate between adjacent frames, as indicated in FIG. 3, which is a graph illustrating LSFs of adjacent frames in case of non-stationary speech, the Y-axis being frequency and the X-axis being frames. In such a case, the optimal concealment method is not the same as in the case of stationary speech signal. For non-stationary speech, the invention provides concealment for bad (corrupted or lost) non-stationary speech segments according to the following algorithm (the non-stationary algorithm):

For i=0 to N−1:

$$\text{partly_adaptive_mean_}LSF(i)=\beta*\text{mean_}LSF(i)+(1-\beta)*\text{adaptive_mean_}LSF(i); \quad (2.3)$$

$$LSF_q1(i)=\alpha*\text{past_}LSF\text{_qood}(i)(0)+(1-\alpha)*\text{partly_adaptive_mean_}LSF(i);$$

$$LSF_q2(i)=LSF_q1(i); \quad (2.2)$$

where N is the order of the LP filter, where α is typically approximately 0.90, where LSF_q1(i) and LSF_q2(i) are two sets of LSF vectors for the current frame as in equation (2.1), where past_LSF_q(i) is LSF_q2(i) from the previous good frame, where partly_adaptive_mean_LSF(i) is a combination of the adaptive mean LSF vector and the average LSF vector, and where adaptive_mean_LSF(i) is the mean of the last K good LSF vectors (which is updated when BFI is not set), and where mean_LSF(i) is a constant average LSF and is generated during the design process of the codec being used to synthesize speech; it is an average LSF of some speech database. The parameter β is typically approximately 0.75, a value used to express the extent to which the speech is stationary as opposed to non-stationary. (It is sometimes calculated based on the ratio of the long-term prediction excitation energy to the fixed codebook excitation energy, or more precisely, using the formula $$\beta = \frac{1 + voiceFactor}{2}$$

where $$voiceFactor = \frac{energy_{pitch} - energy_{innovation}}{energy_{pitch} + energy_{innovation}},$$

in which $energy_{pitch}$ is the energy of pitch excitation and $energy_{innovation}$ is the energy of the innovation code excitation. When most of the energy is in long-term prediction excitation, the speech being decoded is mostly stationary. When most of the energy is in the fixed codebook excitation, the speech is mostly non-stationary.)

For β=1.0, equation (2.3) reduces to equation (1.0), which is the prior art. For β=0.0, equation (2.3) reduces to the equation (2.1), which is used by the present invention for stationary segments. For complexity sensitive implementations (in applications where it is important to keep complexity to a reasonable level), β can be fixed to some compromise value, e.g. 0.75, for both stationary and non-stationary segments.

Spectral Parameter Concealment Specifically for Lost Frames

In case of a lost frame, only the information of past spectral parameters is available. The substituted spectral parameters are calculated according to a criterion based on parameter histories of for example spectral and LTP (long-term prediction) values; LTP parameters include LTP gain and LTP lag value. LTP represents the correlation of a current frame to a previous frame. For example, the criterion used to calculate the substituted spectral parameters can distinguish situations where the last good LSFs should be modified by an adaptive LSF mean or, as in the prior art, by a constant mean.

Alternative Spectral Parameter Concealment Specifically for Corrupted Frames

When a speech frame is corrupted (as opposed to lost), the concealment procedure of the invention can be further optimized. In such a case, the spectral parameters can be completely or partially correct when received in the speech decoder. For example, in a packet-based connection (as in an ordinary TCP/IP Internet connection), the corrupted frames concealment method is usually not possible because with TCP/IP type connections usually all bad frames are lost frames, but for other kinds of connections, such as in the circuit switched GSM or EDGE connections, the corrupted frames concealment method of the invention can be used. Thus, for packet-switched connections, the following alternative method cannot be used, but for circuit-switched connections, it can be used, since in such connections bad frames are at least sometimes (and in fact usually) only corrupted frames.

Figure 6:
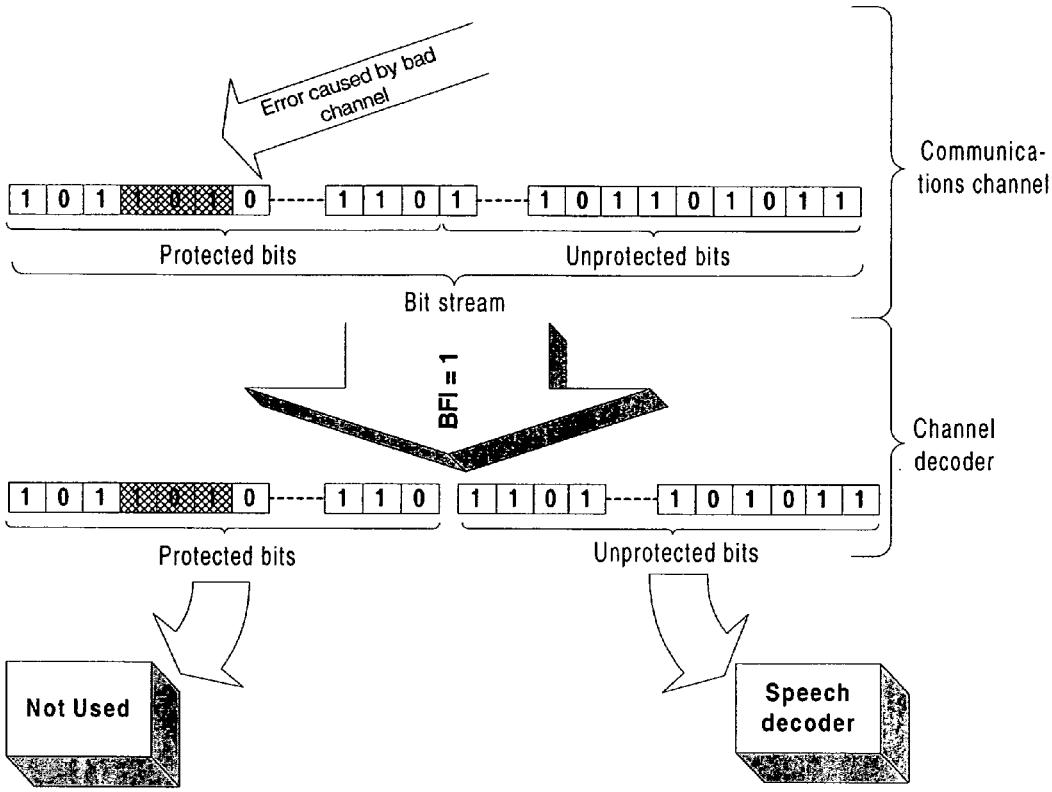
Fig. 6 (Prior art)
FIG. 6. is a schematic flow diagram illustrating how bits are classified according to some prior art when a bad frame is detected.

According to the specifications for GSM, a bad frame is detected when a BFI flag is set following a CRC check or other error detection mechanism used in the channel decoding process. Error detection mechanisms are used to detect errors in the subjectively most significant bits, i.e. those bits having the greatest effect on the quality of the synthesized speech. In some prior art methods, these most significant bits are not used when a frame is indicated to be a bad frame. However, a frame may have only a few bit errors (even one being enough to set the BFI flag), so the whole frame could be discarded even though most of the bits are correct. A CRC check detects simply whether or not a frame has erroneous frames, but makes no estimate of the BER (bit error rate). FIG. 6 illustrates how bits are classified according to the prior art when a bad frame is detected. In FIG. 6, a single frame is shown being communicated, one bit at a time (from left to right), to a decoder over a communications channel with conditions such that some bits of the frame included in a CRC check are corrupted, and so the BFI is set to one.

As can be seen from FIG. 6, even when a received frame sometimes contains many correct bits (the BER in a frame usually being small when channel conditions are relatively good), the prior art does not use them. In contrast, the present invention tries to estimate if the received parameters are corrupted and if they are not, the invented method uses them.

Table 1 demonstrates the idea behind the corrupted frame concealment according to the invention in the example of an adaptive multi-rate (AMR) wideband (WB) decoder.

TABLE 1

Percentage of correct spectral parameters in a corrupted speech frame.

| | C/I [dB] | | | | |
|---|---|---|---|---|---|
| mode 12.65 (AMR WB) | 10 | 9 | 8 | 7 | 6 |
| BER | 3.72% | 4.58% | 5.56% | 6.70% | 7.98% |
| FER | 0.30% | 0.74% | 1.62% | 3.45% | 7.16% |
| Correct spectral parameter indexes | 84% | 77% | 68% | 64% | 60% |
| Totally corrcet spectrum | 47% | 38% | 32% | 27% | 24% |

In case of an AMR WB decoder, mode 12.65 kbit/s is a good choice to use when the channel carrier to interference ratio (C/I) is in the range from approximately 9 dB to 10 dB. From Table 1, it can be seen that in case of GSM channel conditions with a C/I in the range 9 to 10 dB using a GMSK (Gaussian Minimum-Shift Keying) modulation scheme, approximately 35-50% of received bad frames have a totally correct spectrum. Also, approximately 75-85% of all bad frame spectral parameter coefficients are correct. Because of the localized nature of the spectral impact, as mentioned earlier, spectral parameter information can be used in the bad frames. Channel conditions with a C/I in the range 6-8 dB or less are so poor that the 12.65 kbit/s mode should not be used; instead, some other, lower mode should be used.

The basic idea of the present invention in the case of corrupted frames is that according to a criterion (described below), channel bits from a corrupt frame are used for decoding the corrupt frame. The criterion for spectral coefficients is based on the past values of the speech parameters of the signal being decoded. When a bad frame is detected, the received LSFs or other spectral parameters communicated over the channel are used if the criterion is met; in other words, if the received LSFs meet the criterion, they are used in decoding just as they would be if the frame were not a bad frame. Otherwise, i.e. if the LSFs from the channel do not meet the criterion, the spectrum for a bad frame is calculated according to the concealment method described above, using equations (2.1) or (2.2). The criterion for accepting the spectral parameters can be implemented by using for example a spectral distance calculation such as a calculation of the so-called Itakura-Saito spectral distance. (See, for example, page 329 of *Discrete-Time Processing of Speech Signals* by John R Deller Jr, John H. L. Hansen, and John G. Proakis, published by IEEE Press, 2000.)

The criterion for accepting the spectral parameters from the channel should be very strict in the case of a stationary speech signal. As shown in FIG. 3, the spectral coefficients are very stable during a stationary sequence (by definition) so that corrupted LSFs (or other speech parameters) of a stationary speech signal can usually be readily detected (since they would be distinguishable from uncorrupted LSFs on the basis that they would differ dramatically from the LSFs of uncorrupted adjacent frames). On the other hand, for a non-stationary speech signal, the criterion need not be so strict; the spectrum for a non-stationary speech signal is allowed to have a larger variation. For a non-stationary speech signal, the exactness of the correct spectral parameters is not strict in respect to audible artifacts, since for non-stationary speech (i.e. more or less unvoiced speech), no audible artifacts are likely regardless of whether or not the speech parameters are correct. In other words, even if bits of the spectral parameters are corrupted, they can still be acceptable according to the criterion, since spectral parameters for non-stationary speech with some corrupt bits will not usually generate any audible artifacts. According to the invention, the subjective quality of the synthesized speech is to be diminished as little as possible in case of corrupted frames by using all the available information about the received LSFs, and by selecting which LSFs to use according to the characteristics of the speech being conveyed.

Thus, although the invention includes a method for concealing corrupted frames, it also comprehends as an alternative using a criterion in case of a corrupted frame conveying non-stationary speech, which, if met, will cause the decoder to use the corrupted frame as is; in other words, even though the BFI is set, the frame will be used. The criterion is in essence a threshold used to distinguish between a corrupted frame that is useable and one that is not; the threshold is based on how much the spectral parameters of the corrupted frame differ from the spectral parameters of the most recently received good frames.

The use of possible corrupted spectral parameters is probably more sensitive to audible artifacts than use of other corrupted parameters, such as corrupted LTP lag values. For this reason, the criterion used to determine whether or not to use a possibly corrupt spectral parameter should be especially reliable. In some embodiments, it is advantageous to use as the criterion a maximum spectral distance (from a corresponding spectral parameter in a previous frame, beyond which the suspect spectral parameter is not to be used); in such an embodiment, the well-known Itakura-Saito distance calculation could be used to quantify the spectral distance to be compared with the threshold. Alternatively, fixed or adaptive statistics of spectral parameters could be used for determining whether or not to use possibly corrupted spectral parameters. Also other speech parameters, such as gain parameters, could be used for generating the criterion. (If the other speech parameters are not drastically different in the current frame, compared to the values in the most recent good frame, then the spectral parameters are probably okay to use, provided the received spectral parameters also meet the criteria. In other words, other parameters, such as LTP gain, can be used as an additional component to set proper criteria to determine whether or not to use the received spectral parameters. The history of the other speech parameters can be used for improved recognition of speech characteristic. For example, the history can be used to decide whether the decoded speech sequence has a stationary or non-stationary characteristic. When the properties of the decoded speech sequence are known, it is easier to detect possibly correct spectral parameters from the corrupted frame and it is easier to estimate what kind of spectral parameter values are expected to have been conveyed in a received corrupted frame.)

Figure 8:
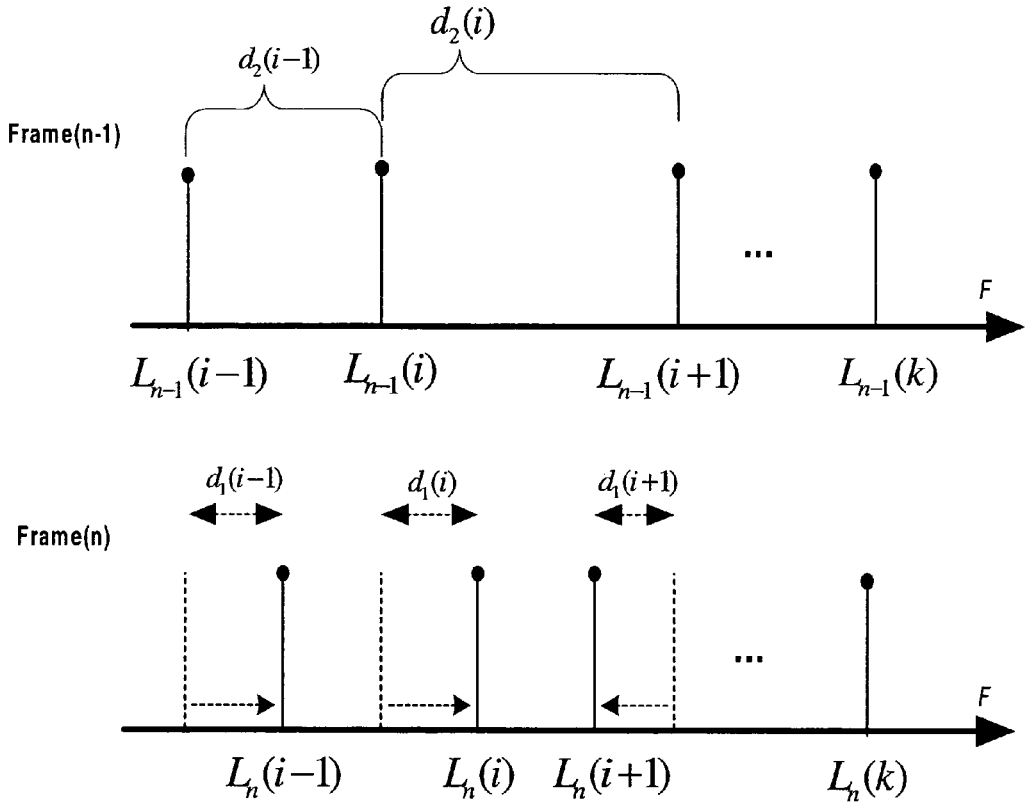
FIG. 8 is a set of two graphs illustrating aspects of the criteria used to determine whether or not an LSF of a frame indicated as having errors is acceptable.

According to the invention in the preferred embodiment, and now referring to FIG. 8, the criterion for determining whether or not to use a spectral parameter for a corrupted frame is based on the notion of a spectral distance, as mentioned above. More specifically, to determine whether the criterion for accepting the LSF coefficients of a corrupted frame is met, a processor of the receiver executes an algorithm that checks how much the LSF coefficients have moved along the frequency axis compared to the LSF coefficients of the last good frame, which is stored in an LSF buffer, along with the LSF coefficients of some predetermined number of earlier, most recent frames.

The criterion according to the preferred embodiment involves making one or more of four comparisons: an inter-frame comparison, an intra-frame comparison, a two-point comparison, and a single-point comparison.

In the first comparison, the inter-frame comparison, the differences between LSF vector elements in adjacent frames of the corrupted frame are compared to the corresponding differences of previous frames. The differences are determined as follows:

$$d_n(i)=|L_{n-1}(i)-L_n(i)|,\ 1\leqq i\leqq P-1,$$

where P is the number of spectral coefficients for a frame, $L_n(i)$ is the $i^{th}$ LSF element of corrupted frame, and $L_{n-1}(i)$ is the $i^{th}$ LSF element of the frame before corrupted frame. The LSF element, $L_n(i)$, of the corrupted frame is discarded if the difference, $d_n(i)$, is too high compared to $d_{n-1}(i)$, $d_{n-2}(i)$, . . . , $d_{n-k}(i)$, where k is the length of the LSF buffer.

The second comparison, the intra-frame comparison, is a comparison of difference between adjacent LSF vector elements in the same frame. The distance between the candidate $i^{th}$ LSF element, $L_n(i)$, of the $n^{th}$ frame and the $(i-1)^{th}$ LSF element, $L_{n-1}(i)$, of the $n^{th}$ frame is determined as follows:

$$e_n(i)=L_n(i-1)-L_n(i),\ 2\leqq i\leqq P-1,$$

where P is the number of spectral coefficients and $e_n(i)$ is the distance between LSF elements. Distances are calculated between all LSF vector elements of the frame. One or another or both of the LSF elements $L_n(i)$ and $L_n(i-1)$ will be discarded if the difference, $e_n(i)$, is too large or too small compared to $e_{n-1}(i), e_{n-2}(i), \ldots, e_{n-k}(i)$.

The third comparison, the two-point comparison, determines whether a crossover has occurred involving the candidate LSF element $L_n(i)$, i.e. whether an element $L_n(i-1)$ that is lower in order than the candidate element has a larger value than the candidate LSF element $L_n(i)$. A crossover indicates one or more highly corrupted LSF values. All crossing LSF elements are usually discarded.

The fourth comparison, the single-point comparison, compares the value of the candidate LSF vector element, $L_n(i)$ to a minimum LSF element, $L_{min}(i)$, and to a maximum LSF element, $L_{max}(i)$, both calculated from the LSF buffer, and discards the candidate LSF element if it lies outside the range bracketed by the minimum and maximum LSF elements.

If an LSF element of a corrupted frame is discarded (based on the above criterion or otherwise), then a new value for the LSF element is calculated according to the algorithm using equation (2.2).

Figure 7:
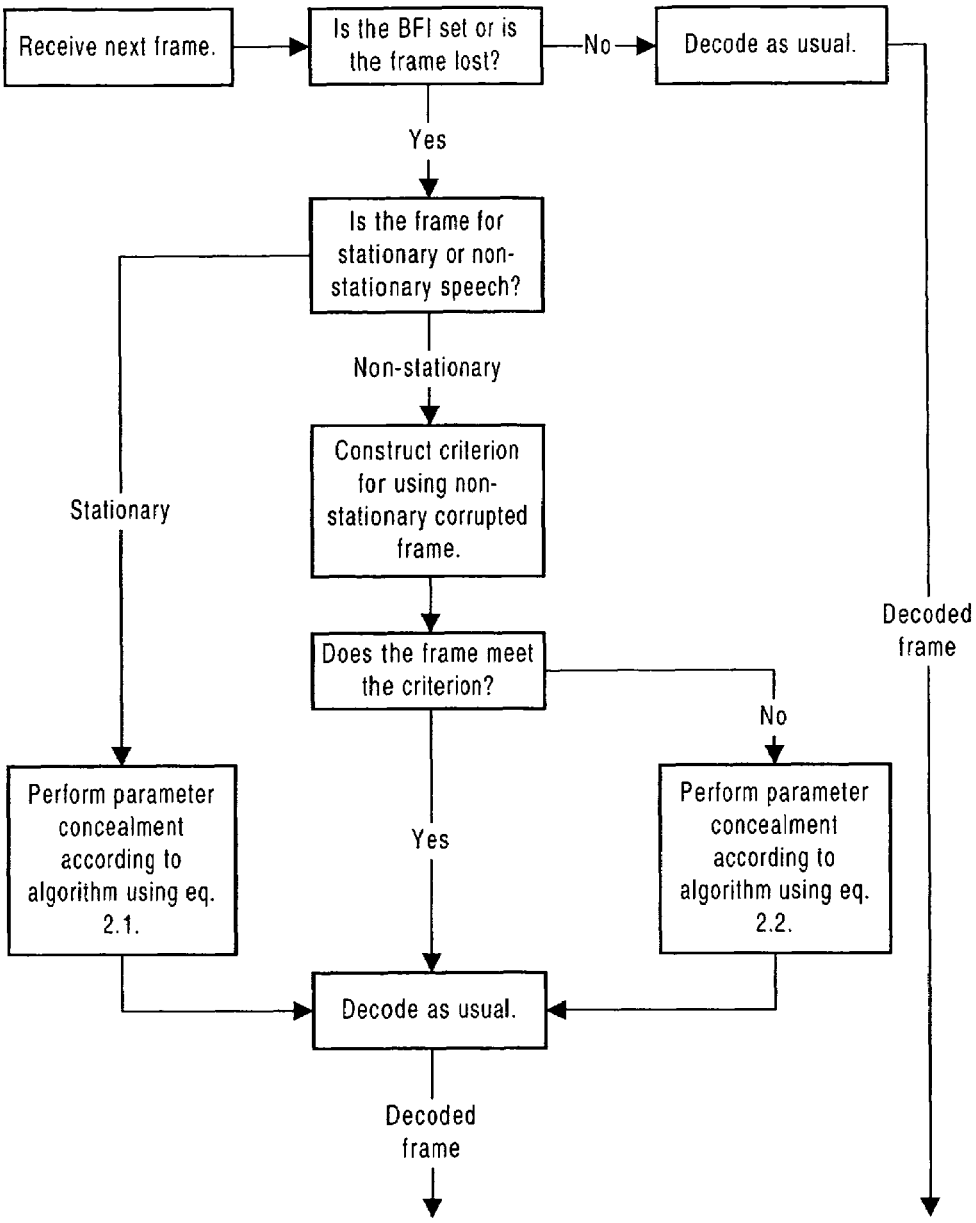
FIG. 7 is a flowchart of the overall method of the invention.

Referring now to FIG. 7, a flowchart of the overall method of the invention is shown, indicating the different provisions for stationary and non-stationary speech frames, and for corrupted as opposed to lost non-stationary speech frames.

DISCUSSION

The invention can be applied in a speech decoder in either a mobile station or a mobile network element. It can also be applied to any speech decoder used in a system having an erroneous transmission channel.

CONCLUSION

It is to be understood that the above-described arrangements are only illustrative of the application of the principles of the present invention. In particular, it should be understood that although the invention has been shown and described using line spectrum pairs for a concrete illustration, the invention also comprehends using other, equivalent parameters, such as immittance spectral pairs. Numerous modifications and alternative arrangements may be devised by those skilled in the art without departing from the spirit and scope of the present invention, and the appended claims are intended to cover such modifications and arrangements.

What is claimed is:

1. A method comprising:

determining whether a frame conveyed to a decoder for speech synthesis is a bad frame, wherein the bad frame comprises spectral parameters that are corrupted or lost; and providing a substitution for the spectral parameters of the bad frame based on a combination of an adaptive mean of the spectral parameters of a predetermined number of the previously and most recently received good frames and a constant or long-term average of spectral parameters.

2. A method as in claim 1, further comprising determining whether the bad frame conveys stationary or non-stationary speech, and wherein said providing is performed in a way that depends on whether the bad frame conveys stationary or non-stationary speech.

3. A method as in claim 2, wherein a frame comprises a plurality of subframes, including a second subframe and a fourth subframe, and wherein in case of the bad frame conveying stationary speech and the speech synthesis is at least based on a linear prediction filter, said providing is performed according to the algorithm:

For i=0 to N−1:

$$\text{adaptive mean}_LSF(i)=(\text{past}_{13}\,LSF_\text{good}(i)(0)+\text{past}_LSF_\text{good}(i)(1)+\ldots+\text{past}_LSF_\text{good}(i)(K-1))/K;$$

$$LSF_q1(i)=\alpha*\text{past}_LSF_\text{qood}(i)(0)+(1-\alpha)*\text{adaptive_mean}_LSF(i);$$

$$LSF_q2(i)=LSF_q1(i);$$

wherein $\alpha$ is a predetermined parameter, wherein N is the order of the linear prediction filter, wherein K is adaptation length, wherein LSF_q1(i) is a quantized line spectral frequency vector of the second subframe and LSF_q2(i) is a quantized line spectral frequency vector of the fourth subframe, wherein past_LSF_qood(i)(0) is equal to a value of the quantity LSF_q2(i−1) from the previous good frame, wherein past_LSF_good(i)(n) is a component of the vector of line spectral frequency parameters from the $n+1^{th}$ previous good frame, and wherein adaptive_mean_LSF(i) is the mean of the previous good line spectral frequency vectors.

4. A method as in claim 2, wherein a frame comprises a plurality of subframes, including a second subframe and a fourth subframe, and wherein in case of the bad frame conveying non-stationary speech and the speech synthesis is at least based on a linear prediction filter, said providing is performed according to the algorithm:

For i=0 to N−1:

$$\text{partly_adaptive_mean}_LSF(i)=\beta*\text{mean}_LSF(i)+(1-\beta)*\text{adaptive_mean}_LSF(i);$$

$$LSF_q1(i)=\alpha*\text{past}_LSF_\text{qood}(i)(0)+(1-\alpha)*\text{partly_adaptive_mean}_LSF(i);$$

$$LSF_q2(i)=LSF_q1(i);$$

wherein N is the order of the linear prediction filter, wherein $\alpha$ and $\beta$ are predetermined parameters, wherein LSF_q2(i) is a quantized line spectral frequency vector of the second subframe and LSF_q2(i) is a quantized line spectral frequency vector of the fourth subframe, wherein past_LSF_q(i) is a value of LSF_q2(i) from the previous good frame, wherein partly_adaptive_mean_LSF(i) is a combination of the adaptive mean line spectral frequency vector and the average line spectral frequency vector, wherein adaptive_mean_LSF(i) is the mean of the last K good line spectral frequency vectors, wherein K is adaptation length, and wherein mean_LSF(i) is a constant average line spectral frequency.

5. A method as in claim 1, further comprising determining whether the bad frame meets a predetermined criterion, and if so, using the bad frame in the speech synthesis instead of said providing.

6. A method as in claim 5, wherein the predetermined criterion involves making one or more of four comparisons: an inter-frame comparison, an intra-frame comparison, a two-point comparison, and a single-point comparison.

7. A method comprising:

determining whether a frame conveyed to a decoder for speech synthesis is a bad frame, wherein the bad frame comprises spectral parameters that are corrupted or lost; and providing a substitution for the spectral parameters of the bad frame, a substitution in which past immittance spectral frequencies are shifted towards a partly adaptive mean given by:

$$ISF_q(i)=\alpha*\text{past}_ISF_q(i)+(1-\alpha)*ISF_{mean}(i), \quad \text{for} \quad i=0\ldots16,$$

where $\alpha=0.9$, $ISF_q(i)$ is the $i^{th}$ component of the immittance spectral frequency vector for a current frame, $\text{past}_ISF_q(i)$ is the $i^{th}$ component of the immittance spectral frequency vector from the previous frame, $ISF_{mean}(i)$ is the $i^{th}$ component of the vector that is a combination of the adaptive mean and a constant predetermined mean immittance spectral frequency vectors, and is calculated using the formula:

$$ISF_{mean}(i)=\beta*ISF_{const_mean}(i)+(1-\beta)*ISF_{adaptive_mean}(i), \text{ for } i=0.16,$$

where $\beta=0.75$, where $$ISF_{\text{adaptive_mean}}(i)=\frac{1}{3}\sum_{i=0}^{2}\text{past_ISF}_q(i)$$

and is updated whenever BFI=0 where BFI is a bad frame indicator, and where $ISF_{const_mean}(i)$ is the $i^{th}$ component of a vector formed from a long-time average of immittance spectral frequency vectors.

8. An apparatus comprising:

means, responsive to a frame conveyed to a decoder for speech synthesis, for determining whether the frame is a bad frame, wherein the bad frame comprises spectral parameters that are corrupted or lost; and means for providing a substitution for the spectral parameters of the bad frame based on a combination of an adaptive mean of the spectral parameters of a predetermined number of the previously and most recently received good frames and a constant or long-term average of spectral parameters.

9. An apparatus as in claim 8, further comprising means for determining whether the bad frame conveys stationary or non-stationary speech, and wherein the means for providing a substitution for the bad frame is configured to perform the substitution in a way that depends on whether the bad frame conveys stationary or non-stationary speech.

10. An apparatus as in claim 9, wherein a frame comprises a plurality of subframes, including a second subframe and a fourth subframe, and wherein in case of the bad frame conveying stationary speech and the speech synthesis is at least partly based on a linear prediction filter, the means for providing a substitution for the bad frame is operative according to the algorithm:

For i=0 to N−1:

$$\text{adaptive_mean}_LSF(i)=(\text{past}_LSF_\text{good}(i)(0)+\text{past}_LSF_\text{good}(i)(1)+\ldots+\text{past}_LSF_\text{good}(i)(K-1))/K;$$

$$LSF_q1(i)=\alpha*\text{past}_LSF_\text{qood}(i)(0)+(1-\alpha)*\text{adaptive_mean}_LSF(i);$$

$$LSF_q2(i)=LSF_q1(i);$$

wherein $\alpha$ is a predetermined parameter, wherein N is the order of the linear prediction filter, wherein K is adaptation length, wherein LSF_q1($i$) is a quantized line spectral frequency vector of the second subframe and LSF_q2($i$) is a quantized line spectral frequency vector of the fourth subframe, wherein past_LSF_qood(i)(0) is equal to a value of the quantity LSF_q2(i−1) from the previous good frame, wherein past_LSF_good(i)(n) is a component of the vector of line spectral frequency parameters from the $n+1^{th}$ previous good frame, and wherein adaptive_mean_LSF(i) is the mean of the previous good line spectral frequency vectors.

11. An apparatus as in claim 9, wherein a frame comprises a plurality of subframes, including a second subframe and a fourth subframe, and wherein in case of a bad frame conveying non-stationary speech and the speech synthesis is at least partly based on a linear prediction filter, the means for providing a substitution for the bad frame is operative according to the algorithm:

For i=0 to N−1:

$$\text{partly_adaptive_mean}_LSF(i)=\beta*\text{mean}_LSF(i)+(1-\beta)*\text{adaptive_mean}_LSF(i);$$

$$LSF_q1(i)=\alpha*\text{past}_LSF_\text{qood}(i)(0)+(1-\alpha)*\text{partly_adaptive_mean}_LSF(i);$$

$$LSF_q2(i)=LSF_q1(i);$$

wherein N is the order of the linear prediction filter, wherein $\alpha$ and $\beta$ are predetermined parameters, wherein LSF_q1(i) is a quantized line spectral frequency vector of the second subframe and LSF_q2(i) is a quantized line spectral frequency vector of the fourth subframe, wherein past_LSF_q(i) is the value of LSF_q2(i) from the previous good frame, wherein partly_adaptive_mean_LSF(i) is a combination of the adaptive mean line spectral frequency vector and the average line spectral frequency vector, wherein adaptive_mean_LSF(i) is the mean of the last K good line spectral frequency vectors, wherein K is an adaptation length, and wherein mean_LSF(i) is a constant average line spectral frequency.

12. An apparatus as in claim 8, further comprising means for determining whether the bad frame meets a predetermined criterion, and if so, using the bad frame instead of substituting for the bad frame.

13. An apparatus as in claim 12, wherein the predetermined criterion involves making one or more of four comparisons: an inter-frame comparison, an intra-frame comparison, a two-point comparison, and a single-point comparison.

14. A mobile station including an apparatus as in claim 8.

15. A network element including an apparatus as in claim 8.

16. An apparatus comprising:

means, responsive to a frame conveyed to a decoder for speech synthesis, for determining whether the frame is a bad frame, wherein the bad frame comprises spectral parameters that are corrupted or lost; and means for providing a substitution for the spectral parameters of the bad frame, a substitution in which past immittance spectral frequencies are shifted towards a partly adaptive mean given by:

$$ISF_q(i)=\alpha*\text{past}_ISF_q(i)+(1-\alpha)*ISF_{mean}(i), \text{ for } i=0\ldots16,$$

where $\alpha=0.9$, $ISF_q(i)$ is the $i^{th}$ component of the immittance spectral frequency vector for a current frame, $\text{past}_ISF_q(i)$ is the $i^{th}$ component of the immittance spectral frequency vector from the previous frame, $ISF_{mean}(i)$ is the $i^{th}$ component of the vector that is a combination of the adaptive mean and a constant predetermined mean immittance spectral frequency vectors, and is calculated using the formula:

$$ISF_{mean}(i)=\beta*ISF_{const_mean}(i)+(1-\beta)*ISF_{adaptive_mean}(i), \text{ for } i=0 \ldots 16,$$

where β=0.75, where $$ISF_{\text{adaptive_mean}}(i) = \frac{1}{3}\sum_{i=0}^{2} \text{past_ISF}_q(i)$$

and is updated whenever BFI=0 where BFI is a bad frame indicator, and where $ISF_{constmean}(i)$ is the $i^{th}$ component of a vector formed from a long-time average of immittance spectral frequency vectors.

17. An apparatus comprising a processor configured to:

determine whether a frame conveyed to a decoder for speech synthesis is a bad frame, wherein the bad frame comprises spectral parameters that are corrupted or lost; and provide a substitution for the spectral parameters of the bad frame based on a combination of an adaptive means of the spectral parameters of a predetermined number of the previously and most recently received good frames and a constant or long-term average of spectral parameters.

18. An apparatus as in claim 17, wherein the processor is further configured to determine whether the bad frame conveys stationary or non-stationary speech, and in providing a substitution for the bad frame, to perform the substitution in a way that depends on whether the bad frame conveys stationary or non-stationary speech.

19. An apparatus as in claim 18, wherein a frame comprises a plurality of subframes, including a second subframe and a fourth subframe, and wherein in case of a bad frame conveying stationary speech and the speech synthesis is at least based on a linear prediction filter, for providing a substitution for the bad frame the processor is configured so as to be operative according to the algorithm:

For i=0 N−1:

$$\text{adaptive_mean}_LSF(i)=(\text{past}_LSF_\text{good}(i)(0)+\text{past}_LSF_\text{good}(i)(1)+\ldots+\text{past}_LSF_\text{good}(i)(K-1))/K;$$

$$LSF_q1(i)=\alpha*\text{past}_LSF_\text{qood}(i)(0)+(1-\alpha)*\text{adaptive_mean}_LSF(i);$$

$$LSF_q2(i)=LSF_q1(i);$$

wherein α is a predetermined parameter, wherein N is the order of the linear prediction filter, wherein K is adaptation length, wherein LSF_q1(i) is a quantized line spectral frequency vector of the second subframe and LSF_q2(i) is a quantized line spectral frequency vector of the fourth subframe, wherein past_LSF_qood(i)(0) is equal to a value of the quantity LSF_q2(i−1) from the previous good frame, wherein past_LSF_good(i)(n) is a component of the vector of line spectral frequency parameters from the $n+1^{th}$ previous good frame, and wherein adaptive_mean_LSF(i) is the mean of the previous good line spectral frequency vectors.

20. An apparatus as in claim 18, wherein a frame comprises a plurality of subframes, including a second subframe and a fourth subframe, and wherein for providing a substitution for the bad frame in case of a bad frame conveying non-stationary speech and the speech synthesis is at least based on a linear prediction filter, the processor is configured so as to be operative according to the algorithm:

For i=0 to N−1:

$$\text{partly_adaptive_mean}_LSF(i)=\beta*\text{mean}_LSF(i)+(1-\beta)*\text{adaptive_mean}_LSF(i);$$

$$LSF_q1(i)=\alpha*\text{past}_LSF_\text{qood}(i)(0)+(1-\alpha)*\text{partly_adaptive_mean}_LSF(i);$$

$$LSF_q2(i)=LSF_q1(i);$$

wherein N is the order of the linear prediction filter, wherein α and β are predetermined parameters, wherein LSF_q1(i) is a quantized line spectral frequency vector of the second subframe and LSF_q2(i) is a quantized line spectral frequency vector of the fourth subframe, wherein past_LSF_q(i) is the value of LSF_q2(i) from the previous good frame, wherein partly_adaptive_mean_LSF(i) is a combination of the adaptive mean line spectral frequency vector and the average line spectral frequency vector, wherein adaptive_mean_LSF(i) is the mean of the last K good line spectral frequency vectors, wherein K is an adaptation length, and wherein mean_LSF(i) is a constant average line spectral frequency.

21. An apparatus as in claim 17, wherein the processor is further configured to determine whether the bad frame meets a predetermined criterion, and if so, to use the bad frame instead of substituting for the bad frame.

22. An apparatus as in claim 21, wherein for determining whether the bad frame meets the predetermined criterion, the processor is configured to make one or more of the following four comparisons: an inter-frame comparison, an intra-frame comparison, a two-point comparison, and a single-point comparison.

23. A mobile station including an apparatus as in claim 17.

24. A network element including an apparatus as in claim 17.

25. An apparatus comprising a processor configured to:

determine whether a frame conveyed to a decoder for speech synthesis is a bad frame, wherein the bad frame comprises spectral parameters that are corrupted or lost; and provide a substitution for the spectral parameters of the bad frame, a substitution in which past immittance spectral frequencies are shifted towards a partly adaptive mean given by:

$$ISF_q(i)=\alpha*\text{past}_ISF_q(i)+(1-\alpha)*ISF_{mean}(i), \text{ for } i=0 \ldots 16,$$

where

α=0.9, $ISF_q(i)$ is the $i^{th}$ component of the immittance spectral frequency vector for a current frame, $\text{past_ISF}_q(i)$ is the $i^{th}$ component of the immittance spectral frequency vector from the previous frame, $ISF_{mean}(i)$ is the $i^{th}$ component of the vector that is a combination of the adaptive mean and a constant predetermined mean immittance spectral frequency vectors, and is calculated using the formula:

$$ISF_{mean}(i)=\beta*ISF_{const_mean}(i)+(1-\beta)*ISF_{adaptive_mean}(i), \text{ for } i=0 \ldots 16,$$

where β=0.75, where $$ISF_{\text{adaptive_mean}}(i) = \frac{1}{3}\sum_{i=0}^{2} \text{past_ISF}_q(i)$$

and is updated whenever BFI=0 where BFI is a bad frame indicator, and where $ISF_{const_mean}(i)$ is the $i^{th}$ component of a vector formed from a long-time average of immittance spectral frequency vectors.

* * * * *

UNITED STATES PATENT AND TRADEMARK OFFICE

CERTIFICATE OF CORRECTION

PATENT NO. : 7,529,673 B2
APPLICATION NO. : 11/402220
DATED : May 5, 2009
INVENTOR(S) : Jari Mäkinen et al.

It is certified that error appears in the above-identified patent and that said Letters Patent is hereby corrected as shown below:

In column 12, line 8, claim 3, line 8 after "adaptive" --_-- should be inserted.

In column 12, line 8, claim 3, line 8 "13" should be --_--.

In column 12, line 43, claim 4, line 14 "LSF_q2(i)" should be --LSF_q1(i)--.

In column 13, line 19, claim 7, line 23 "i=0.16" should be --i=0..16--.

In column 15, line 7, claim 16, line 27 "constmean" should be --const_mean--.

In column 15, line 39, claim 19, line 8 before "N-1" --to-- should be inserted.

Signed and Sealed this

Eighteenth Day of August, 2009

David J. Kappos

David J. Kappos
*Director of the United States Patent and Trademark Office*